US005678957A

United States Patent [19]

Lipsker

[11] Patent Number: 5,678,957

[45] Date of Patent: Oct. 21, 1997

[54] METHOD FOR UNDERGROUND EXCAVATION

[76] Inventor: Yitshaq Lipsker, 24, Trumpeldor Str., Ramat Hasharon 47264, Israel

[21] Appl. No.: 584,186

[22] Filed: Jan. 11, 1996

[30] Foreign Application Priority Data

Jan. 25, 1995 [IL] Israel ..... 112441

[51] Int. Cl.[6] ..... E02D 29/00; E21D 9/00; E21D 9/06; E21D 9/08; E21D 11/00; E21D 20/00

[52] U.S. Cl. ..... 405/149; 405/141; 405/262; 405/267

[58] Field of Search ..... 405/124–126, 405/132, 139–141, 262, 267, 149

[56] References Cited

U.S. PATENT DOCUMENTS

| | | | |
|---|---|---|---|
| 3,858,400 | 1/1975 | Bernold | 405/141 X |
| 4,073,148 | 2/1978 | Zaretti | 405/149 X |
| 4,422,798 | 12/1983 | Bonvoisin | 405/132 |
| 4,725,168 | 2/1988 | Fagundes | 405/262 |
| 4,728,225 | 3/1988 | Brandl et al. | 405/262 |
| 4,907,910 | 3/1990 | Teron | 405/132 |

FOREIGN PATENT DOCUMENTS

| | | |
|---|---|---|
| 2 014 634 | 8/1979 | United Kingdom . |
| WO 94/19272 | 9/1994 | WIPO . |

*Primary Examiner*—Tamara L. Graysay
*Assistant Examiner*—Tara L. Mayo
*Attorney, Agent, or Firm*—Gary M. Nath; Nath & Associates

[57] ABSTRACT

A method for underground excavation below an area, without opening the area above the excavation, the method comprising constructing at least a pair of diaphragm walls, the walls being at two opposite sides of the area and extend substantially from the surface area to beneath the lowest level of the excavation. Either prior or after constructing the walls, a plurality of tunnels are bored under the surface area, with the tunnels extending from one diaphragm wall of a pair to another and having a diameter allowing them to accommodate one or more cables. Then, the one or more cables are inserted through the tunnels, and tensioned with their ends anchored to two diaphragm walls of a pair and excavating is performed between said diaphragm walls and beneath the cables.

6 Claims, 6 Drawing Sheets

METHOD FOR UNDERGROUND EXCAVATION

FIELD OF THE INVENTION

The present invention is in the field of excavation and more specifically it is concerned with a method for underground excavation without digging the surface area above the excavation, i.e., without removing the surface ground.

BACKGROUND OF THE INVENTION

At times, it is required to perform large underground excavations without removing the surface area, e.g., under existing buildings or roads, for constructing underground car parks or passages or for underground transportation means. The problem involved with such underground excavation is supporting the surface area from collapse during excavation.

One way for performing such excavations is by gradually excavating and simultaneously constructing support walls and a ceiling. This method considerably slows down the excavation process, highly increases its costs, and may even endanger workers' lives because of occasional collapse of the not yet supported walls and ceiling.

Another method is to open very wide trenches along two opposite edges of the area to be excavated and then insert a plurality of horizontal steel or concrete beams adjacent one another, extending between the trenches at the ceiling level of the excavation. Then, support walls are constructed under the edges of the beams and thereafter the soil between the walls is removed. The drawback of this method is that it requires large engineering equipment for digging the trenches and for inserting the solid steel beams into the ground and is thus not suitable for excavating in confined areas, e.g., between or under buildings, roads or parks. This method also causes a severe disturbance in surrounding areas. Furthermore, this is a time consuming method and the excavation is limited to the practical length of the beams.

Another disadvantage of the known excavation methods is that existing underground communication or electric cables and the like and pipes must be relocated or detoured prior or during excavation, by itself an expensive and time consuming operation.

It is the object of the present invention to provide a new method for underground excavations below a surface, whereby the surface is supported from collapse, during excavations by novel means. It is particularly an object of the invention to provide such a method useful for excavations below constructed areas, such as below buildings, roads, etc.

SUMMARY OF THE INVENTION

According to the present invention, there is provided a method for underground excavation below an area, without opening the area above the excavation, the method comprising the steps of:

(a) constructing at least a pair of diaphragm walls, the pair being at two opposite sides of said area, the diaphragm walls extending substantially from the surface area to beneath the lowest level of the excavation;

(b) either prior or after (a), boring a plurality of tunnels under said surface area, the tunnels extending from one diaphragm wall of a pair to another and having a diameter allowing them to accommodate one or more cables;

(c) inserting the one or more cables through the tunnels;

(d) tensioning the one or more cables and anchoring their ends to two diaphragm walls of a pair; and (e) excavating between said diaphragm walls and beneath the cables.

Preferably, at least two pairs of diaphragm walls are constructed whereby a latticework is created by the tensioned cables at their intersection.

Still preferably after anchoring the one or more cables to the diaphragm walls, they are grouted by injecting a grouting cement or other suitable grouting substances into the cable-containing tunnels. It is at times advantageous after excavating, to consolidate the ceiling soil by grouting or by combined grouting and soil nailing or by any other method known in the art.

According to one embodiment of the present invention, said diaphragm walls are supported by substantially horizontal beams or boards extending between the diaphragm walls and under said tunnels, said beams or boards support the walls and prevent their inward collapsing. Furthermore the beams or boards provide additional support to the ceilings.

In order to prevent the diaphragm walls from inwardly collapsing under the load of the suspended ceiling, in accordance with another embodiment of the invention, said diaphragm walls may also be anchored to the exterior ground by various anchoring means, or by means of substantially vertical pillars or support walls cast adjacent the diaphragm walls.

By a further embodiment of the present invention a large excavation may be carried out by performing two excavations adjacent one another, wherein each two adjacent pairs of diaphragm walls share a common diaphragm wall.

BRIEF DESCRIPTION OF THE DRAWINGS

For better understanding, the invention will now be described by way of example only, with reference to the accompanying drawings, in which.

Figure 4:
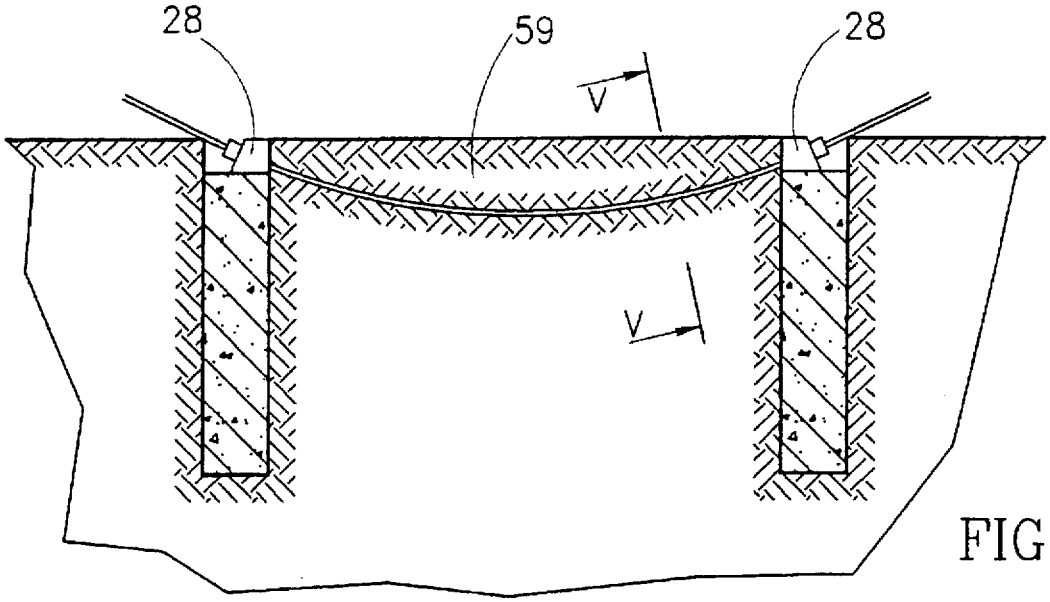
FIG. 4 is a cross-sectional view is in FIGS. 1 to 3 illustrating a fourth step of the excavation method according to the present invention.
Figure 8:
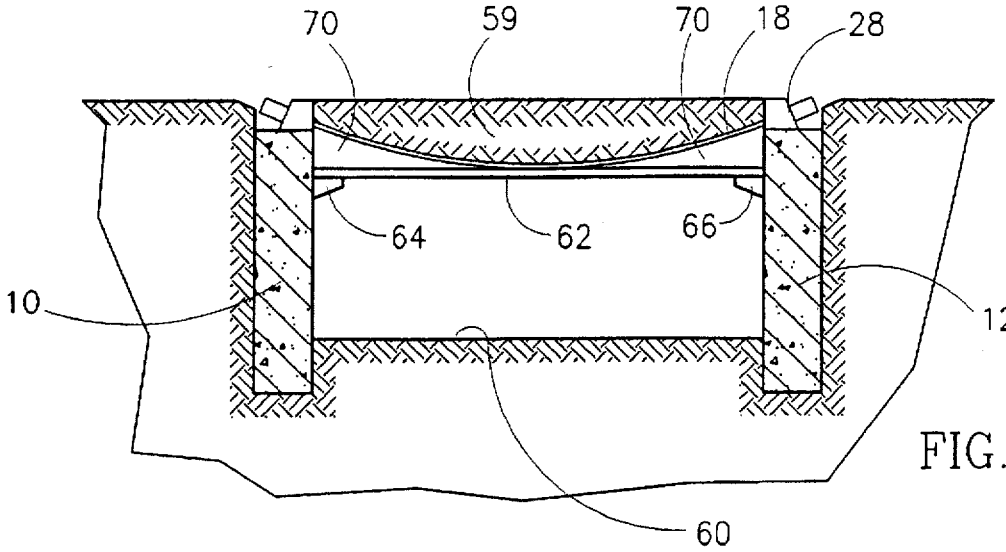
Figure 9:
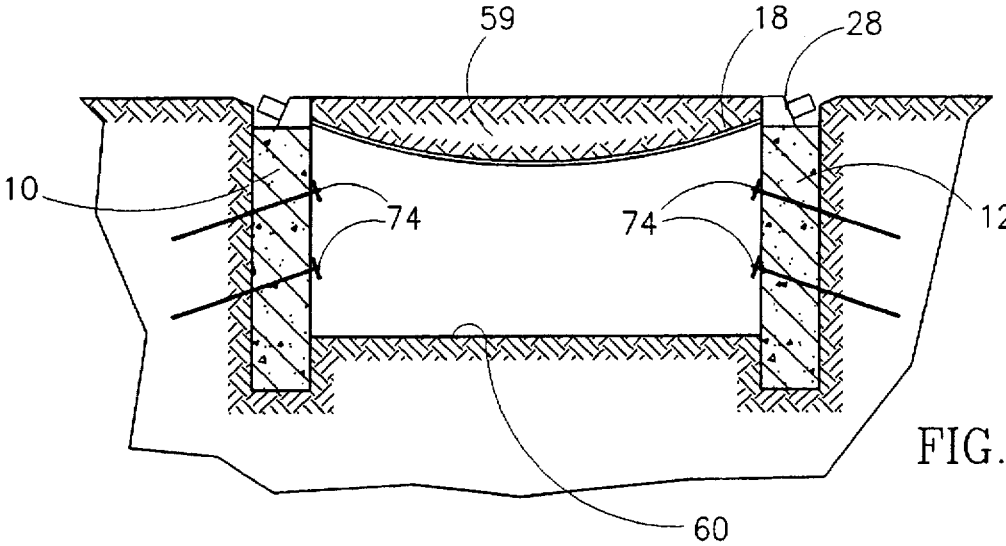
Figure 10:
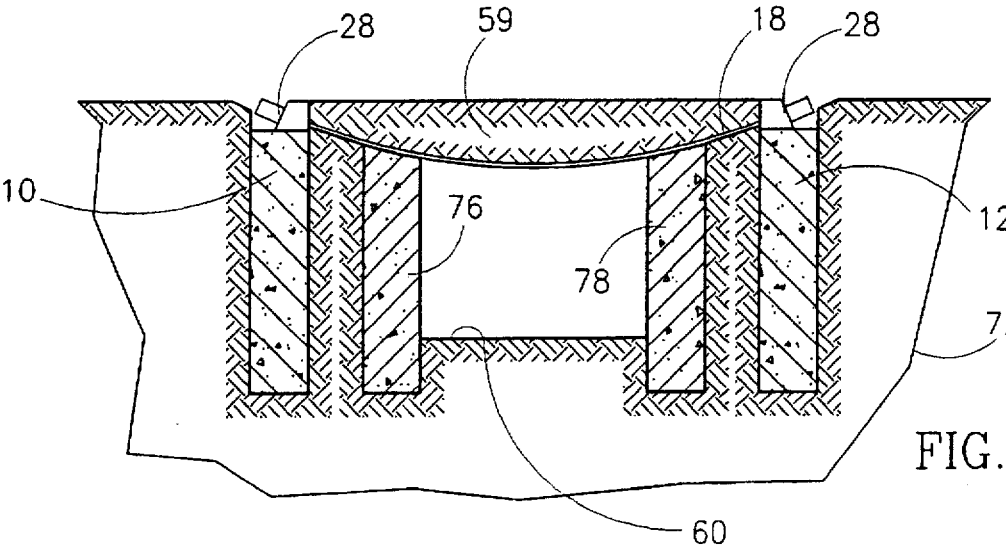
Figure 11:
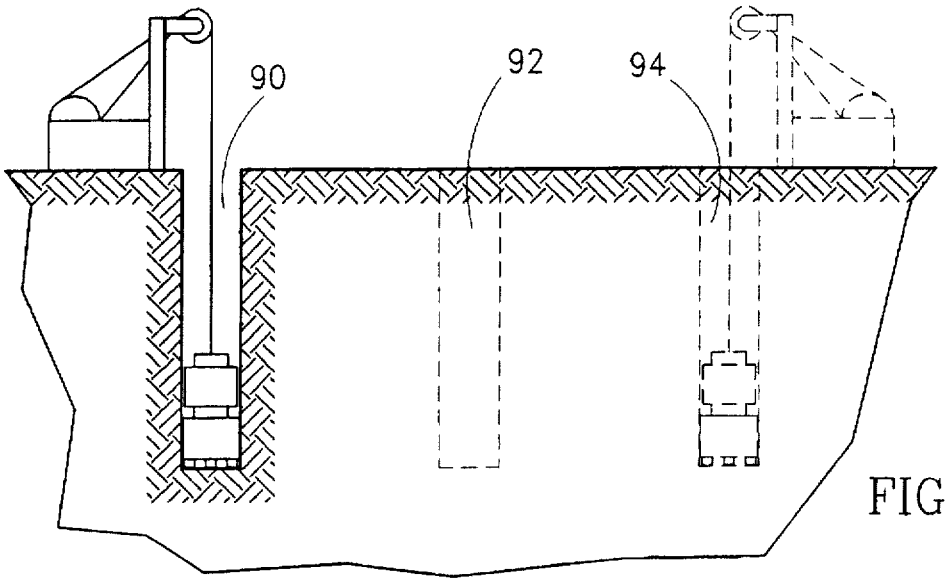
Figure 12:
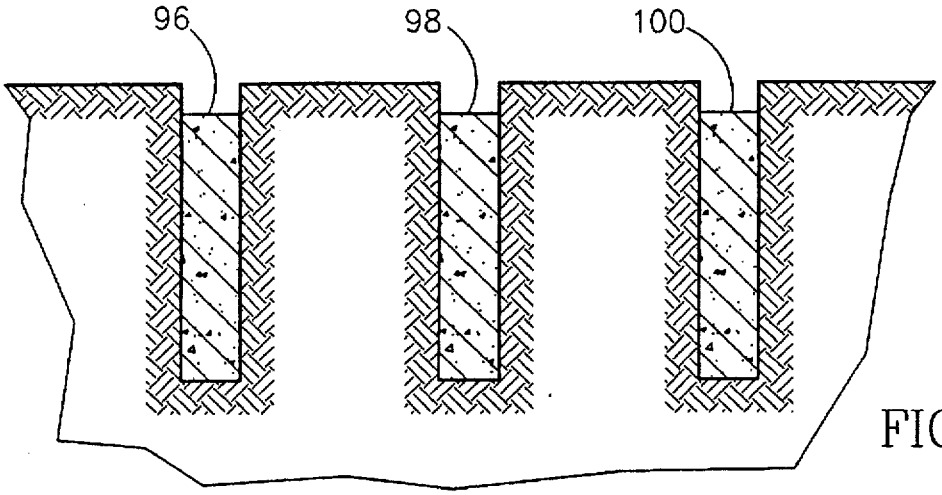
Figure 13:
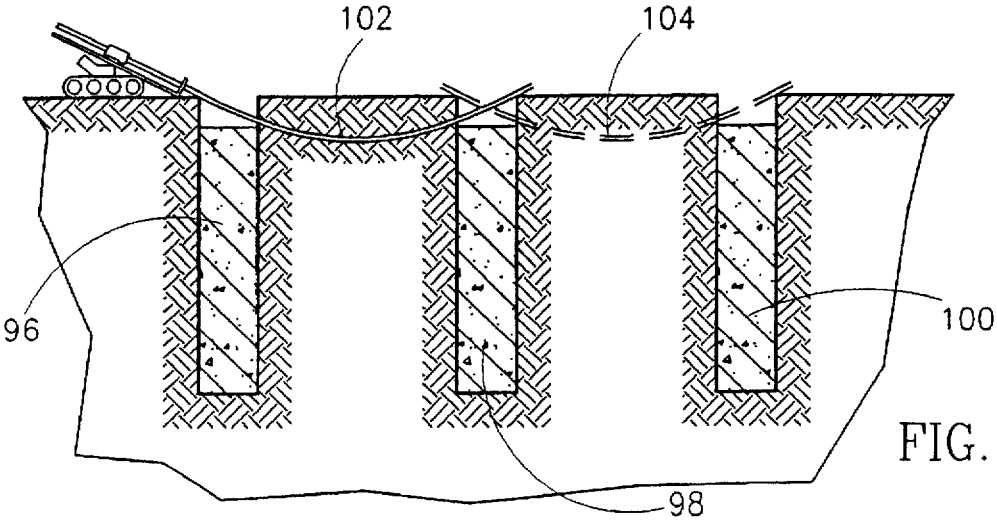
Figure 14:
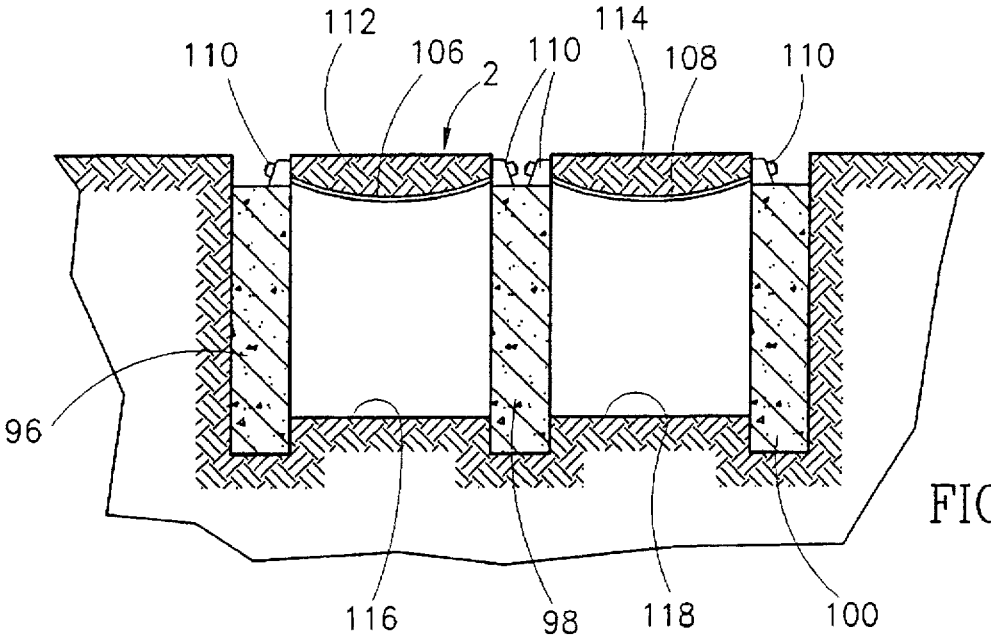
Figure 15:
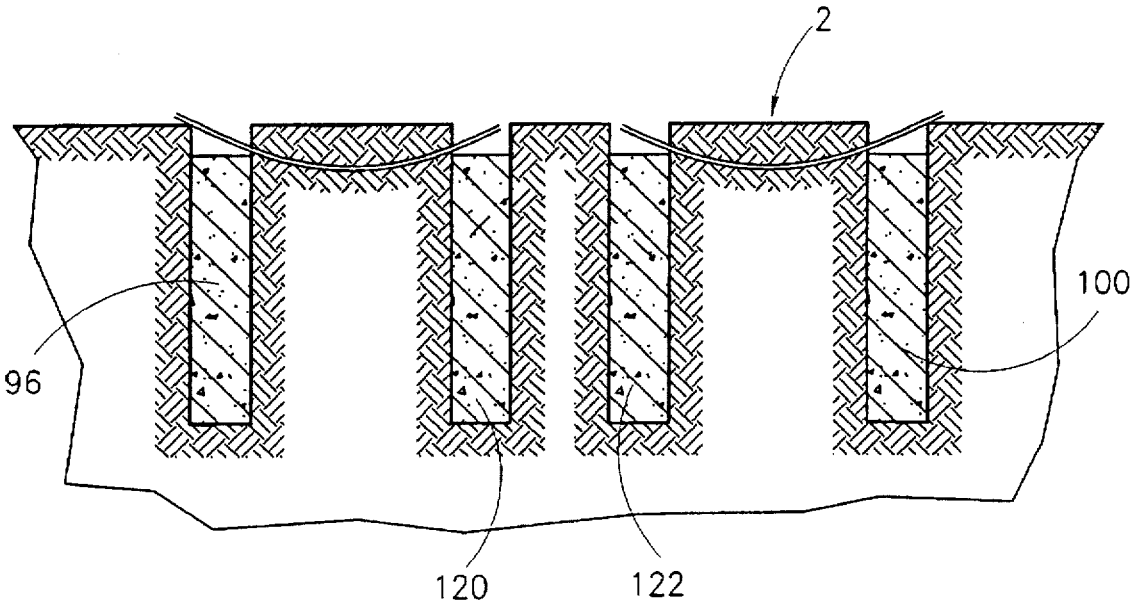

FIGS. *7a* and *7b* are further cross-sectional views along lines V—V in FIG. 4 illustrating further embodiments of a cable;

FIG. 8 is a cross-sectional view of an excavation performed according to the present invention illustrating horizontal support beams;

FIG. 9 is a cross-sectional view as in FIG. 8 illustrating how the diaphragm walls may be anchored to the exterior ground;

FIG. 10 is a cross-sectional view as in FIG. 9 illustrating how the diaphragm walls may be supported by support walls;

FIG. 11 is a schematic cross-sectional illustration of a first step in performing a large excavation according to the present invention;

FIG. 12 is a cross-sectional view as in FIG. 11 illustrating the second step in performing a large excavation according to the present invention;

FIG. 13 is a cross-sectional view as in FIGS. 11 and 12 illustrating the third step in performing a large excavation according to the present invention;

FIG. 14 is a schematic cross-sectional view as in FIG. 13 illustrating a completed large excavation according to the present invention; and FIG. 15 is a schematic cross-sectional view of another embodiment of a large excavation according to the invention.

DETAILED DESCRIPTION OF SPECIFIC EMBODIMENTS

Figure 1:
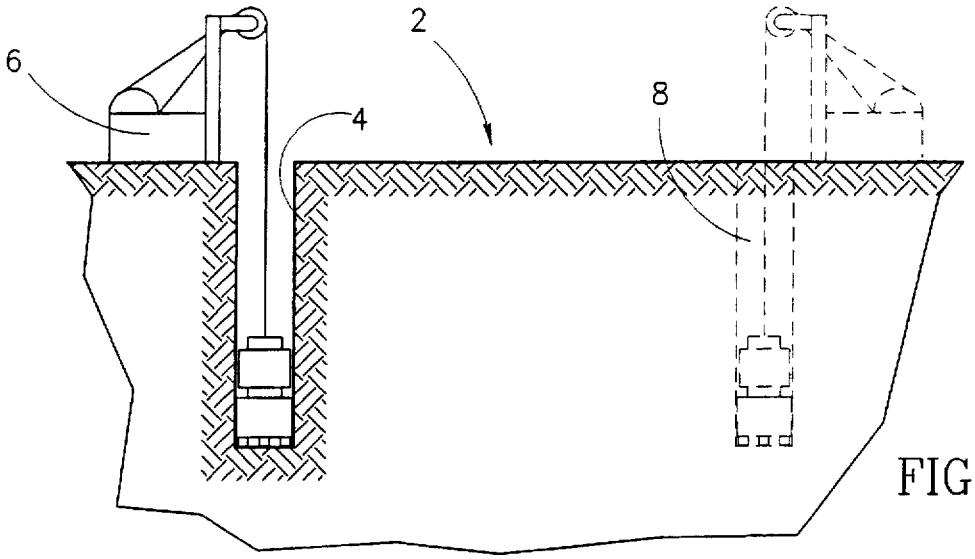
FIG. 1 is a schematic cross-sectional view illustrating a first step of the excavation method according to the present invention.
Figure 2:
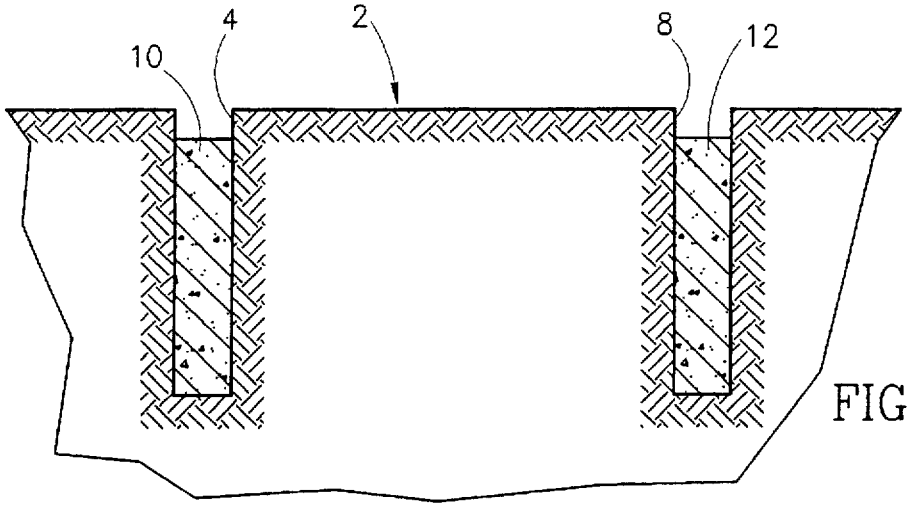
FIG. 2 is a cross-sectional view as in FIG. 1 illustrating a second step of the excavation method according to the present invention.
Figure 3:
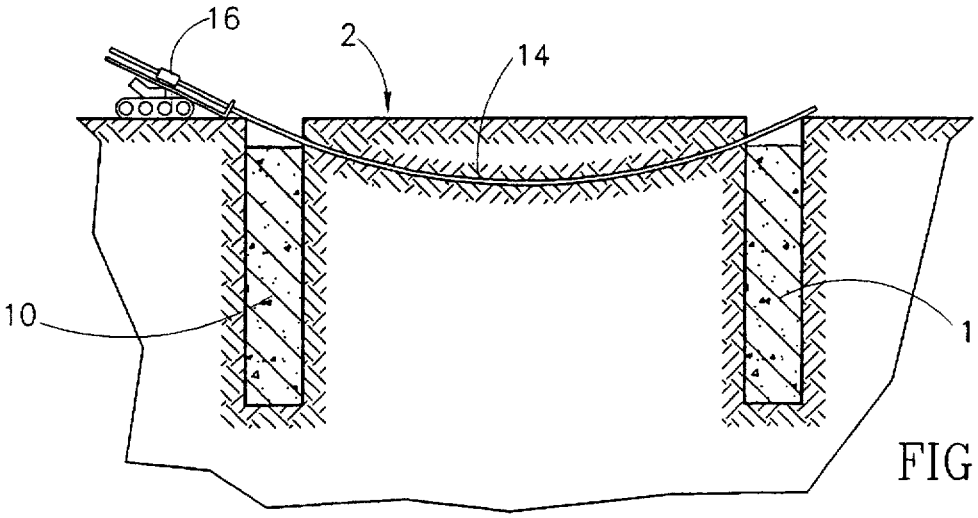
FIG. 3 is a cross-sectional view as in FIGS. 1 and 2 illustrating a third step of the excavation method according to the present invention.

Reference is first being made to FIGS. 1 to 4 of the drawings schematically illustrating how an excavation according to the invention is carried out. In FIG. 1, there is shown a ground surface 2 underneath which is required to perform an excavation without digging the surface area 2.

At a first step a trench 4 is excavated by excavating equipment 6, the trench being substantially deeper than the height of the intended excavation. Then, a second trench 8 (shown in dashed lines) is excavated opposite the trench 4.

If it is required to perform the excavation adjacent or under existing structures, then special excavating machinery is required for performing the trenches 4 and 8. The structure and method of operation of such excavating machinery enabling trench excavating at confined areas and in limited space, are disclosed in detail in PCT Publication No. WO 94/19272 of the Applicant of the present application, which is incorporated herein by way of reference.

After digging of the trenches 4 and 8 is completed, diaphragm walls 10 and 12 are cast into the trenches 4 and 8, respectively, forming together a pair of diaphragm walls and confining the excavation area. The walls 10 and 12 may be reinforced concrete walls poured into the trenches 4 and 8 or, may be pre-fabricated elements inserted into the trenches. Alternatively, the diaphragm walls may consist of a plurality of pillars adjacent one another.

A plurality of arcuated tunnels 14 are bored by a directional drilling system 16 of the type designed for trenchless installation of utilities such as electric and communication cables, water and gas pipes, etc. The directional drilling is performed under any obstacles such as pipes, foundations of existing construction above the surface area 2, etc., and the direction of the drilling is controlled for example by an ultrasonic navigation system as known per se.

Figure 5:
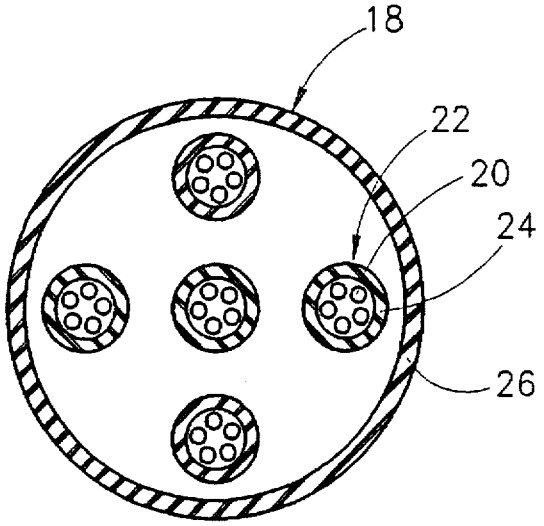
FIG. 5 is a cross-section along lines V—V in FIG. 4.

A cable generally designated 18 is then pulled through each of the tunnels 14. As seen in FIG. 5, the cable 18 consists of a plurality of steel cables 20 bundled in bundles 22, each bundle is coated by a polyurethane coating 24 and the bundles are bunched in an outer polyurethane coating 26, the coating serving to protect the steel cables 20 from corrosion. After inserting the cables 18 through the tunnels 14 they are stressed by known means at predetermined forces depending on the type of soil, load on the surface area, etc.. Then they are anchored to the diaphragm walls 10 and 12 by means of anchoring elements 28 as known per se in the art and according to which as the tensioning force grows, the anchoring of the cables within the anchoring elements 28 becomes firmer. Tightening each cable enables regulating the position of each of the cables, whereby all the cables are brought to a position in which they are substantially parallel to one another both in the horizontal and vertical planes and whereby the height of the suspended ceiling is accurately determined.

After the cables 18 are tensioned, the space between the diaphragm walls 10 and 12 is excavated as known, per se, whereby ceiling 59 actually becomes suspended over the cables.

The distance between two adjacent cables 18 depends on the load the cables are due to carry as well as the type of soil, where for light soils and for heavy loads, more cables at smaller intervals are used. For heavy loads it is also possible to use thicker cables.

Figure 6:
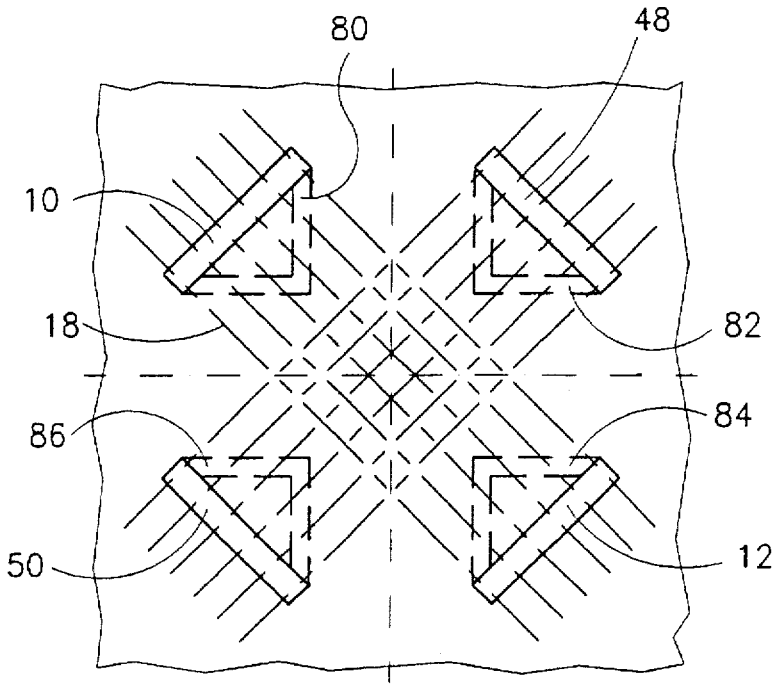
FIG. 6 is a schematic top view of an excavation site according to the present invention.

However, in order to improve grasping of the suspended ground 59 and in order to reduce load from the diaphragm walls 10 and 12 another pair of diaphragm walls 48 and 50 are constructed as shown in the schematic top view of FIG. 6. The diaphragm walls 48 and 50 are constructed at a substantially right angle with respect to walls 10 and 12, although not restricted to a right angle. In this way, after the cables are tensioned between the walls of each of the pairs, a latticework is established which provides better support for the suspended ground and practically all the walls of the excavation are erected.

Figure 7A:
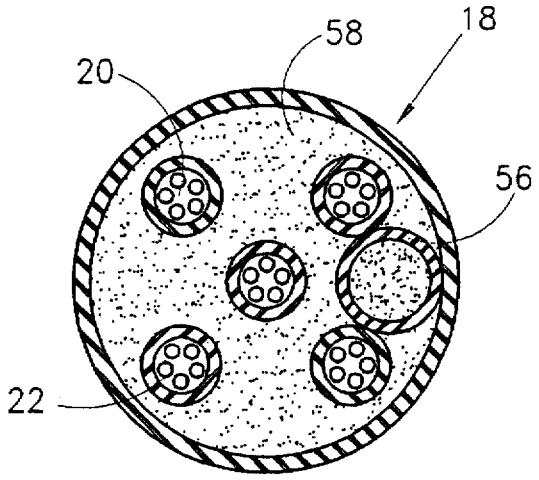
Figure 7B:
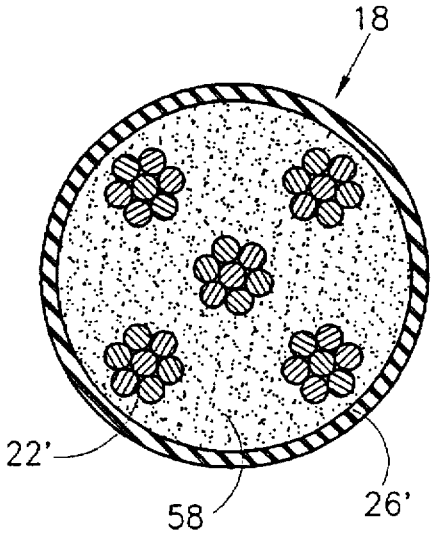

Reference is now made to FIGS. 7(*a*) and 7(*b*) illustrating different embodiments of cable 18. In the embodiment of FIG. 7(*a*) the steel cables 20 are bundles in bundles 22 as already explained, leaving some polyurethane tubes 56 hollow, without steel cables therein. Prior to tensioning the cables as explained herein-above, the vicinities within the cable 18 and within the hollow tubes 56 are filled with a grouting chemical or cement substance 58 poured into the cables, whereby the grouted stressed steel cables become elastic arched beams.

In the embodiment of FIG. 7(*b*), the bundles of cables 22' are not each coated by a polyurethane coating but only an external coating 26' is provided. In this embodiment too, the cable is grouted by chemical cement 58 prior to tensioning of the cables 18, yielding a strengthened cable.

Attention is now directed to FIG. 8, in which after completing the excavation, a floor 60 is constructed, either poured at site or pre-fabricated and laid at site, and support beams (or boards) 62 are mounted on brackets 64 and 66 on the diaphragm walls 10 and 12, respectively. The beams or boards 62 are made of steel or pre-stressed concrete which may be pre-fabricated element or cast at the site. The beams serve both to prevent the diaphragm walls 10 and 12 from inward collapse and to further support the suspended ceiling 59 and so reduce some load from the cables 18.

Furthermore, the gaps 70 between the beams or boards 62 and between the cables 18 may Serve for accommodating water and gas pipes, electrical and communication cables, etc.. If beams are used, than boards (not shown) may be attached to the beams to cover the ceiling for decorative purposes.

In FIG. 9, it is shown how the diaphragm walls 10 and 12 are anchored to the exterior ground 72 by ground anchors 74 as known, per se. The purpose of the anchoring is to prevent inward collapsing of the diaphragm walls 10 and 12 under load of the tensioned cables 18 and suspended ceiling 59.

In order to improve connection between the soil of the suspended ceiling 59 and the cables 18, various soil consolidation techniques may be used as known by those versed in the art, e.g. grouting, soil nailing using metal studs and chemical or concrete cements, attaching a network and applying concrete thereto by the so-called "shotcrete" method, etc. One possible grouting method is by pressurizing the grouting agents through a punctured polyurethane cable coating 26 (not shown), coating the cables 18.

Another method of supporting the diaphragm walls 10 and 12 is illustrated in FIG. 10, wherein support walls 76 and 78 are constructed adjacent the diaphragm walls 10 and 12, respectively. The support walls 76 and 78 extend up to the cables 18 and in this way bear some of the load of the suspended ceiling 59. If required, the support walls 76 and 78 may be anchored (not shown) to the diaphragm walls 10 and 12, respectively.

Referring back to FIG. 6 of the drawings, another arrangement of support walls 80, 82, 84 and 86 is shown in dashed lines, the walls having a triangular cross-sectioned shape which is a stronger structure useful in supporting the diaphragm walls, in particular, under heavy loads.

It should be obvious to a person versed in the art that any combination of supporting the construction, i.e., anchoring the walls, use of support beams or support walls may be used for improving the stability of the construction. It should also be understood that the tunnels may be drilled prior to excavating the trenches or after.

Referring now to FIGS. 12 to 15 of the drawings, it will be explained how the method of the present invention is used in performing substantially large underground excavations by excavating two or more excavations adjacent one another. In order to enable large excavations, the load of the suspended ceiling should be divided over more diaphragm walls and over cables which are shorter than the overall width of the excavation.

For that purpose, three trenches 90, 92 and 94 are excavated at substantially equal distances from one another and diaphragm walls 96, 98 and 100 are cast as explained hereinabove. Then, a plurality of parallel tunnels 102 and 104 are drilled between the pairs of walls 96, 98 and 100 by the directional trenchless drilling equipment. Thereafter, cables 106 and 108 are inserted into the tunnels 102 and 104, respectively, and after pre-stressed, the cables are fastened by anchoring means 110 as already explained. After completing the suspending construction of ceilings 112, 114, the spaces between the diaphragm walls 96, 98 and 100 are excavated and floors 116 and 118 are cast or laid.

In cases of extreme ceiling loads or when a large central diaphragm wall may not be constructed due to some obstacle, e.g., existing foundations of structures or hard rock disabling trenching, it may be required to construct two central diaphragm walls 120 and 122 being slightly remote from one another as seen in FIG. 15.

It is also possible to create openings in the diaphragm walls for access from the ground surface, e.g. for underground transportation stations or, for a large excavation constructed with one or more central diaphragm walls, openings may be performed in the diaphragm walls to enable access between compartments.

By still another embodiment of the invention, the construction of the excavation may be constructed with a number of underground stories. According to this modification, an excavation is performed as above explained, with substantially deep diaphragm walls. Then, the floors are laid, either gradually as the excavation proceeds downwardly, or only after concluding the excavation. The floors may be pre-fabricated or poured at the site and may be provided with openings for passage between the stories. The floors serve also as supports for preventing the diaphragm walls from inward collapse.

It should be readily understood that the support constructions, and means discussed hereinabove in relation to FIGS. 1 to 10, may be applied also to the embodiments of FIGS. 11 to 15.

I claim:

1. A method for underground excavation below an area, without opening the area above the excavation, the method comprising the steps of:

(a) constructing at least a pair of diaphragm walls, the pair being at two opposite sides of said area, the diaphragm walls extending substantially from the surface area to beneath the lowest level of the excavation;

(b) either prior or after (a), boring a plurality of tunnels under said surface area, the tunnels extending from one diaphragm wall of a pair to another and having a diameter allowing them to accommodate one or more cables;

(c) inserting the one or more cables through the tunnels;

(d) tensioning the one or more cables and anchoring their ends to two diaphragm walls of a pair; and (e) excavating between said diaphragm walls and beneath the cables.

2. A method according to claim 1, wherein at least two pairs of diaphragm walls are constructed, whereby a latticework is created by the tensioned cables, at their intersection.

3. A method according to claim 1, comprising grouting of the tunnels after inserting the one or more cables.

4. A method according to claim 1, comprising adding substantially horizontal beams or boards extending between the diaphragm walls under said tunnels.

5. A method according to claim 1, comprising anchoring of said diaphragm walls to the ground exterior of said area; at any stage after step (a).

6. A method according to claim 1, for excavating two or more excavations under two or more areas adjacent one another, wherein there are at least two pair of diaphragm walls, with the at least two pair having one wall in common so that each two .adjacent excavations share a common diaphragm wall.

* * * * *